US006409060B2

(12) United States Patent
Donine

(10) Patent No.: US 6,409,060 B2
(45) Date of Patent: Jun. 25, 2002

(54) CHILD CARRIER WITH ENHANCED BACK AND SHOULDER SUPPORT AND RETRACTABLE INFANT SEAT

(76) Inventor: Michael T. Donine, 43218 Business Park Dr., No. 108, Temecula, CA (US) 92590

( * ) Notice: Subject to any disclaimer, the term of this patent is extended or adjusted under 35 U.S.C. 154(b) by 0 days.

(21) Appl. No.: 09/745,601

(22) Filed: Dec. 22, 2000

Related U.S. Application Data

(60) Provisional application No. 60/171,458, filed on Dec. 22, 1999.

(51) Int. Cl.[7] ..... A61G 1/00
(52) U.S. Cl. ..... 224/160; 224/646; 224/647
(58) Field of Search ..... 224/158, 159, 224/160, 161, 637, 638, 639, 640, 643, 644, 646, 647, 648, 649

(56) References Cited

U.S. PATENT DOCUMENTS 3,871,562 A * 3/1975 Grenier ..... 224/160
4,037,764 A * 7/1977 Almosnino et al. ..... 224/160
4,579,264 A * 4/1986 Napolitano ..... 224/158
4,724,988 A * 2/1988 Tucker ..... 224/160
5,246,152 A * 9/1993 Dotseth ..... 224/158
5,522,528 A * 6/1996 Petricola ..... 224/160
5,848,741 A * 12/1998 Fair ..... 224/160
5,927,576 A * 7/1999 Nielsen ..... 224/160

* cited by examiner

*Primary Examiner*—Stephen K. Cronin
(74) *Attorney, Agent, or Firm*—Donn K. Harms

(57) ABSTRACT

An improved child carrier capable of carrying both infants and larger toddlers. The device features a removable infant seat insert to accommodate the seating requirements of smaller infants in the larger seat panel. The infant seat insert may either be removably attached to the device or in an alternate embodiment is deployable from a pocket formed in the body support panel. The carrier also features a strapping arrangement that allows lateral translation of the shoulder straps to aid in comfort during use and an arrangement at the waist band to keep the seat of the device generally upright when the wearer bends forward.

16 Claims, 9 Drawing Sheets

CHILD CARRIER WITH ENHANCED BACK AND SHOULDER SUPPORT AND RETRACTABLE INFANT SEAT

This application is a Continuing in Part Application and claims the benefit of application Ser. No. 60/171,458 filed Dec. 22, 1999.

FIELD OF THE INVENTION

This invention relates to a backpack style apparatus for carrying children. More particularly it relates to a shoulder supported apparatus to transport an infant or small child on the chest area of the care provider, whereby the infant may be facing forward or backward, toward the care provider. The device features improvements that are applicable to provide improvement to current conventional infant carriers as well as used in combination to yield the preferred embodiment of the disclosed device. In addition to other disclosed features, the disclosed device features improved shoulder strap configuration to provide a pivot to the carrier when the user bends over from a standing position and also features a retractable infant seat portion that may be stored in a closeable pocket when the device is used on a larger child.

BACKGROUND OF THE INVENTION

This device as herein disclosed and described provides a new and unique combination of utility from one or a combination of improved components. The best mode of the device would of course feature all of the disclosed improved components, however, the components by themselves, in selective combinations, or in combination with conventional infant carriers, would also yield increased safety, utility, and function for such carriers and use in combination with existing carriers is anticipated.

One component providing great utility to the user is the addition of an infant seat insert which provides a strong and stable seat for carrying newborn infants. As in the growing athletic environment where hiking is a common healthy family activity, small light carriers do not suffice. Some children, even though they can walk, enjoy the close contact of a parent, where often they will be carried on the shoulders. With this device a child can be turned facing forward or backward, producing a more enjoyable and safer activity. There is a pressing need for an infant carrier with the durability and strength to carry a larger child of 40 pounds or more, on long hikes. When weights of this magnitude are carried for any appreciable distance, the weight must remain centered on the torso of the body, and distributed evenly. The disclosed device herein more than adequately fills the need for an athletic style infant carrier, using extra wide reciprocating shoulder straps which laterally translate during movement by the user in their cross mount with a large padded back support piece.

U.S. Pat. No. 178,309 (Bichelor) teaches an infant carrier formed of a soft body having a back section for supporting the back of an infant, and spaced apart side sections and side bolsters for supporting the sides of an infant. This is a light duty infant carrier for transporting small infants for a short period of time. This device has been designed for carrying the infant facing the care provider, with lightly cushioned straps bearing down on the shoulders.

U.S. Pat. No. 4,149,687 (Nunemacher) describes a baby pouch which supports an infant in the front of the care provider. This is another light device for carrying a small infant for a short time period. This unit has thin shoulder straps with a single cushioned pad bearing directly on the back of the neck.

U.S. Pat No. 5,772,088 (Nelson) teaches an infant carrier including a sack of flexible sheet material dimensioned to receive an infant. This is yet, another light duty apparatus for transporting a very small infant and requires the care provider to lift the infant down into the carrier. This action of lowering the infant down into the carrier is easily accomplished with small infants, but becomes difficult or impossible as the child increases in size.

U.S. Pat. No. 5,673,828 (Raedel) describes another light infant carrier but lacks shoulder cushions and the ability to provide even weight distribution of the load on the user especially when used for long periods.

U.S. Pat. No. 4,492,326 (Storm) teaches a sling type infant carrier, wherein an infant generally "hangs" at the crotch of the user. In this apparatus the infant's arms and legs constrained from moving freely. Further, the weight of the infant is borne primarily on the shoulders of the person wearing the carrier, thereby inducing neck and shoulder strain.

U.S. Pat. No. 5,224,637 (Columbo) reveals a waist-mounted infant carrier, wherein the infant sits on a seat structure into a belt worn around the waist of the wearer. Although the infant sits comfortably on the seat structure, and the weight of the infant is borne primarily on the waist and lower back of the wearer. Further, the carrier lacks straps to secure the infant against the body of the wearer, thus requiring the wearer to constantly hold the infant. At least one arm of the wearer must hold the infant in the carrier.

U.S. Pat. No. 4,941,604 (Nagareda)describes a front pack infant carrier, wherein an infant sits on a padded rectangular seat of flexible material and is secured against the body of the wearer by a thin, horizontal strap. The weight of the infant is thus borne primarily by the shoulders of the person wearing the infant carrier.

As such, there is a continuing need for new and improved for an infant carrier and components that may individually or in combination be added to existing carriers, that allows adjustment for the size of the infant being carried. Additionally, such a carrier should provide for even distribution of the weight of the child to the upper body of the user and should provide a strap system that allows the carrier straps to reciprocate during use to lessen the shock to occupant and user during movement. Still further, such a carrier should easily allow a manner to keep the child in the carrier in a substantially upright position when the user bends over during use and should provide easy ingress and egress of the child from the carrier during use.

SUMMARY OF THE INVENTION

This disclosed device relates to an infant carrier which will adapt to the size of the intended infant to be carried using a retractable seat insert. In addition to providing a secure mount for infants, the device features components which render it capable of holding and removing a child up to forty pounds or more depending upon the strength of the care provider. The weight of the occupant situated in the carrier is translated through two wide webbing straps attached at both ends to the device and communicating therebetween over the shoulders of the user. The two straps are constructed to cross the back of the user in an "X" crossover and communicated through two tracks formed in a cushioned one piece back support unit by perpendicular straps at the edges of the back support forming the tracks. The straps communicated through the back support unit in such a fashion as to laterally translate or reciprocate between two points in the tracks formed in the back support unit. This reciprocating action during use provides shock absorption of the load on the user as well as helping reduce shoulder strain.

The straps communicating from the top of the device to attachment at the bottom translate over both shoulders and feature strap-mounted cushions to protect the shoulders of the care provider from chaffing during use and provide easier adjusting of the straps to distribute the weight to the central part of the back, below the neck. The straps are attached to the back support unit at the lower extremity, allowing the straps to shift over the cushioned areas of the shoulders.

The infant carrier body support panel portion of the device is best comprised of moisture resistant foam filled fabric due to the inherent hazards of carrying very young children for long periods of time. The carrier body support panel portion features a unique shape whereby the upper portion may be folded up and attached to the shoulder straps by means of claps to rings affixed at varying portions on the shoulder straps to provide a means of adjustment of the upper portion of the carrier to support a small infants head or a larger child's back. Means of adjustment of strap length to accommodate the varying size of the infant are made by moving one or both clasps up or down on their respective attachment to the shoulder straps.

The body support panel portion adjacent to the head support panel of the infant carrier is generally triangular in shape with clasps affixed to the upper two corners for removable and adjustable attached to any of the plurality of rings affixed to the two shoulder straps. Midway down the angular infant carrier a belt is provided for the user that when affixed properly, wraps around the occupant's waist, with a length adjustment and quick release buckle of one side.

The lower seat portion or crotch area of the infant carrier is connected to two waist belts of tubular belting material which wrap around the care provider and removably attach using cooperating fasteners, to the distal end of the shoulder straps which exit their path through the back support unit. Adjustment to the length of the two waist belts may be made by the user by pulling on the distal end of the belt that communicates through the cooperating fastener affixed to the distal end of the belts. At the attachment of the waist belts to the seat portion a cushioning material is provided that keeps the belts from chaffing the inner thigh of the occupant.

A fabric hinge of sorts is formed using various components of the device to cause the lower end of the infant carrier to move away from the user's waist when the user bends over in a pendulum fashion, thus keeping the infant substantially upright. This fabric hinge is formed by a stiffener sewn into the waist belts immediately adjacent to the cushioning material which intersects a substantially perpendicular strap communicating between the waist belt and the lower end of the front of the harness. The stiffener sections on the waist belt and the inherent stiffness of the cushioned section form a fabric hinge at their mutual intersection which collapses when the user is upright and extends when the user bends over causing the bottom of the device to pendulum out away from the user when bending over.

The shoulder strap connecting belts are sewn to the ends of the shoulder straps at the front, with a length adjustment on each. A unique substantially 90° cushioned bend is sewn in the shoulder strap connecting belt that makes the belt conform more comfortably to the upper torso of the care provider. The series of rings sewn on the front of the shoulder straps allows the lower portion of the infant carrier to be adjusted to a number of different positions of comfort for the occupant and the care provider. The rings also allow the upper portion of the infant carrier to be folded down behind the lower portion and attached with the clasps to shorten the support area or add head support by putting the upper portion in place. Snaps have been added to the shoulder straps for the attachment of convenience items such as bibs, baby bottle holders and toys. The length adjustment of the shoulder connecting belts and the waist belts allow the care provider to achieve a comfortable fit no matter what their size. To put on the infant carrier it must be raised up and over the head of the care provider and lowered to rest on the shoulders, and the waist belt buckle engaged.

For removal, the buckle on the waist belt is released and the device is then raised over the head for removal. The preferred method of inserting and removing the infant would be to have the care provider in the sitting position, releasing the shoulder strap clasps, and laying the infant carrier open in the lap. The infant is positioned on the carrier facing either up or down, then raised with the carrier, while attaching the clasps to the rings on the shoulder straps.

The carrier is also able to accommodate a wide range of newborn infants with implementation of the infant insert which is an insert into the support panel. The infant insert is best made of soft, water repellent, cushioned fabric, to be used when the infant is small and may slide to either side of the support panel. The insert has two holes for the legs of the infant to go through for seating therein. To mount the insert in the device and a belt at the back is provided to encircle the lower portion of the support panel. Other means of removable attachment might also be used such as snaps or hook and loop fabric so long as the attachment achieved is secure.

In the depicted embodiment of FIG. 3 a means of attachment to the body support panel is provided at both sides of the top side of the insert are sleeves that the clasps and the triangular ends of the lower portion of the carrier are fed through prior to attachment to the rings on the shoulder straps. Additional support is achieved with the waist belt of the support panel. However hook and loop fabric might also be used as a means of attachment.

It is an object of this invention to provide a versatile and adjustable lightweight carrier that is comfortable for both the infant and the care provider.

Another object of this invention is to provide a carrier product that may be used over a longer period of time for one infant by provision of size adjustability.

Still another object of the invention the provision of an infant carrier with removably or retractable inserts that may vary depending upon the size of the intended occupant.

As noted, other infant carriers described herein disclose similar frontal, lightweight carrying devices with thin straps going over the neck and shoulders. These carriers may be adequate with small infants, but with a larger child they tend to bear heavily on the trapezius muscles of the neck and shoulders of the care provider, and with excessive use, may cause permanent damage. A much greater weight can be carried safely and comfortably when centered on the upper torso of the body, uniformly spread over a wider area of the back and shoulders, and kept away from the neck using the disclosed device and components thereof.

BRIEF DESCRIPTION OF THE DRAWING FIGURES

The accompanying drawings, which are incorporated in and form a part of this specification, illustrate preferred embodiments of the disclosed device and together with the description, serve to explain the principles of the invention.

DETAILED DESCRIPTION OF THE PREFERRED EMBODIMENTS OF THE DISCLOSED DEVICE

Figure 1:
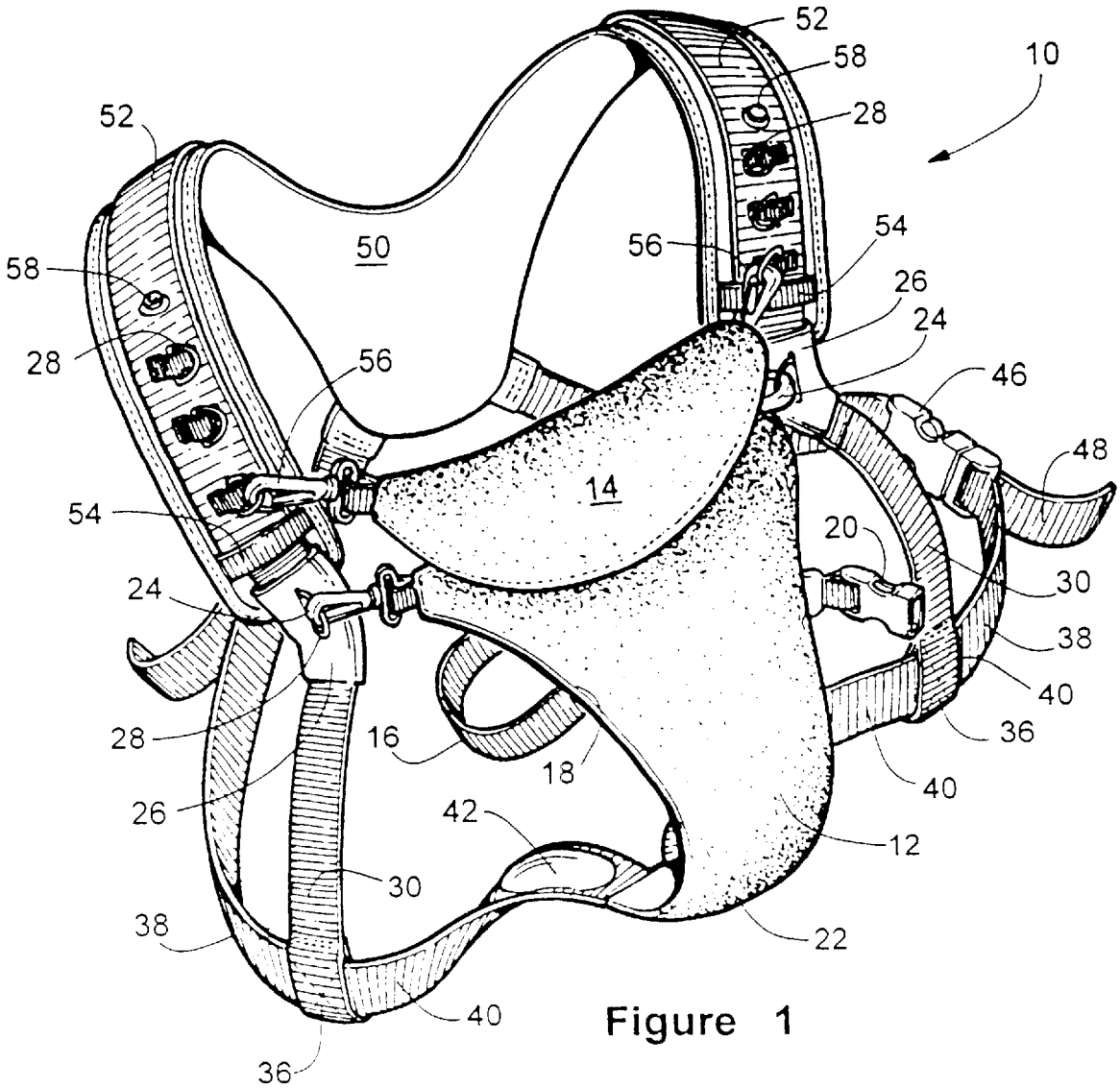
FIG. 1 depicts a frontal perspective view a preferred embodiment of the infant carrier assembly.
Figure 2:
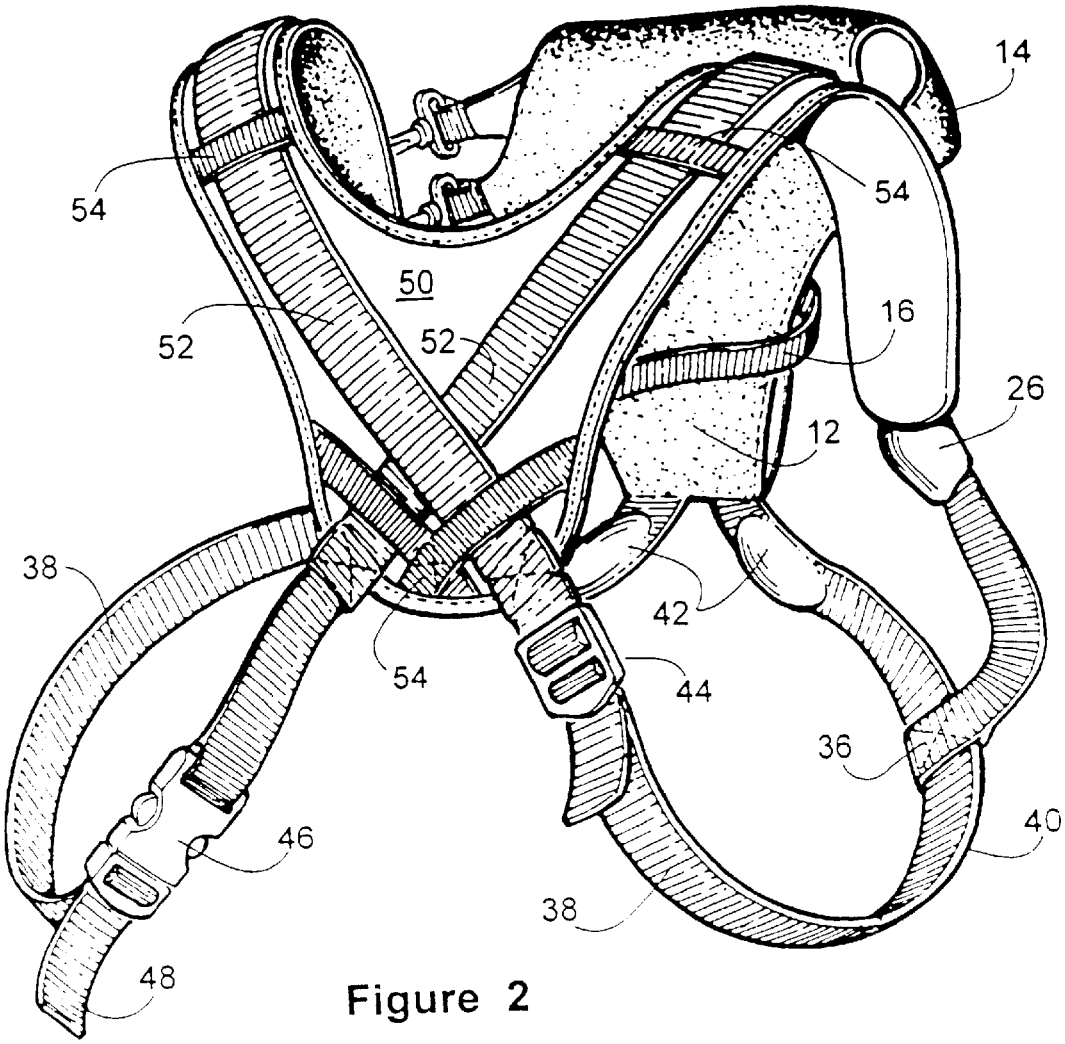
FIG. 2 depicts a rear perspective a preferred embodiment of the infant carrier assembly.

Referring now to the drawing FIG. 1 showing the disclosed device 10 in a perspective view displaying the generally triangular shaped infant body support panel 12 with the attached head support panel 14 folded down. An infant retainer belt 16 is attached midway down the sides 18 of the infant carrier support panel 12 having a cooperating fastener in the form of a quick release buckle 20 which also provides a path for length adjustment of the belt 16. The infant retainer belt 16 serves as a safety to keep the child secure during wearing of the device 10 and additionally to allow the user the option to detach the top of the support panel 12 and fold or rotate it downward to a horizontal position on a secure platform such as the user's knees to remove the infant or change a diaper or allow the infant lie down with the safety or a retainer belt 16 restraining the infant in case of sudden movement that might cause injury.

The seat portion or crotch 22 is located at the lower extremity of support panel 12. Affixed on the upper two corners of the carrier body support panel 12 are the two primary attachment clasps 24 that provide a means of attachment of the carrier body support panel 12 to the shoulder strap connecting belt 30 adjacent to cushioned bend 26 using cooperating fasteners depicted as rings 28 in the shoulder strap connecting belt 30 which accommodate clasps 24 for removable engagement therewith.

A stiffener 40 is affixed internally into waist belt 38 immediately adjacent to a cushioned section 42 of the waist belt 30 at the connection point where the waist belt 30 is affixed to the bottom of the body unit 12. This stiffener 40 positioned between the cushioned section 42 and immediately adjacent to the attachment point 36 of shoulder strap 30 to waist belt 38, forms a fabric hinge as the stiffener 40 and cushion 42 tend to keep the belt 38 semi rigid. The result being that the belt 38 tends only to bend in the section between the cushion 42 and belt 38 which can easily be defined or determined by the length of each. This fabric hinge as noted earlier tends to collapse or bend at the defined point between the cushion 42 and the stiffener 40 when the user is upright. Thus, when the user bends forward the bottom of the body unit 12 swings forward in a pendulum fashion, thereby tending to keep the child substantially upright and providing a means to keep the body support panel 12 and child more upright when the wearer bends forward. Of course a piece of webbing of a length determined to allow sufficient slack to define the amount of swing of the bottom of the body unit away from the bending user might also be used and is anticipated, however the use of the stiffener or the stiffener and the cushion together are the current best mode and provide additional utility.

Figure 11:
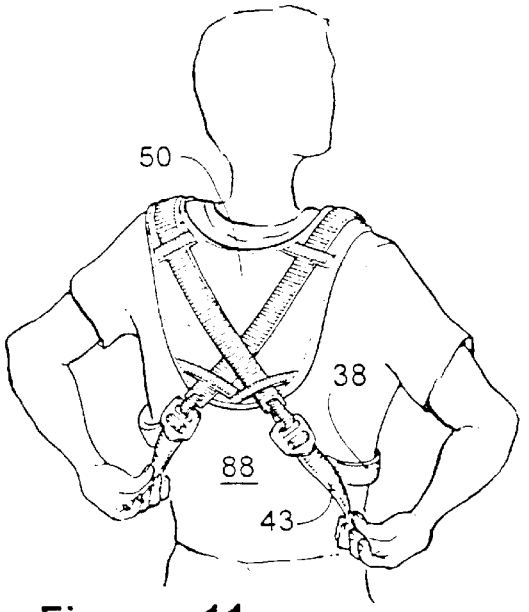
FIG. 11 depicts a care provider adjusting the waist belt length using a means of adjustment in the form of adjustment mechanisms, by pulling the ends of the belts.

As noted, adjacent to the stiffener section 40 in waist belt 38 is cushioned section 42 that is filled with a foam or similar soft material providing a means to prevent chaffing of the occupant's legs by padding this area of the waist belt 40 thus protecting the inner thighs of a child sitting in the device 10. The other end of one of the waist belts 38 features an adjustment buckle 44 which has a path therethrough at the attachment to the waist belt 38, to allow the distal end of the belt 38 to be pulled back on itself, thereby providing a means to adjust the length of the waist belt 38 to accommodate the user. The buckle 44 is of a two-piece cooperating fastener variety with the second half of the piece being affixed to the distal end of a second half of the waist belt 38 which extends to a connection at the other end with the shoulder straps 52. As shown in FIG. 11 a simple tug on the belt end 43 will shorten the belt 38 to the user's liking. Both waist belts 38 are affixed by means of sewing one end of the waist belt 38 to the distal end of the shoulder straps 52 adjacent to the exit of the shoulder straps 52 from the shoulder cushioning support 50 from the track formed on the support between the two parallel in-line cross belts 54 that form the track.

The shoulder straps 52 cross at the back and traverse over the shoulders to be attached to the shoulder strap connecting belt 30, adjacent to the cushioned bend 26 which in the current best mode is formed at substantially 90 degrees. The shoulder straps 52 follow two defined paths or tracks formed on the back support panel 50 by the means of several in line parallel cross belts 54 sewn to the back support panel 50, with each pair of cross belts 54 forming a path for a shoulder strap 52 therebetween. The shoulder straps 52 follow their respective paths and because they are not stationarily affixed to the support panel 50 the can laterally translate on the surface of the shoulder support panel 50 and under the cross belts 54 in the path formed between the two cross belts 54 forming the path for each strap. This reciprocating or laterally translating movement provided by the paths between the cross belts 54 allows the shoulder straps 52 to laterally translate during use and shift slightly for the comfort of the care provider. The lateral translation may be limited by the attachment of the fastener 44 which is too large to fit under the cross belt 54 and thus limits the lateral translation upward. Of course other means for affixing the shoulder straps 52 diagonally across the surface of the support panel might be used so long as they allow lateral translation, however the current best mode uses the disclosed parallel inline pairs of cross belts 54.

A plurality of rings 28 are attached to the front of shoulder straps 52 and the shoulder strap connection belts, thereby providing vertical support provided by the shoulder straps 52 as well as a means for adjustment of the height of the top of the infant carrier body support panel 12 on the user by changing the position of the attachment of the clasps 24 affixed to the body support panel 12 and clasps 56 on the upper head support panel 14. Optionally cooperating snaps 58 or other fasteners may also incorporated on the front of shoulder straps 52 for the convenience of the user thereby providing a means for removably attachment of infant desired devices such as a bib 60, a bottle holder, or toys or other devices that feature a cooperating fastener capable of attachment to the snap 58.

Figure 3:
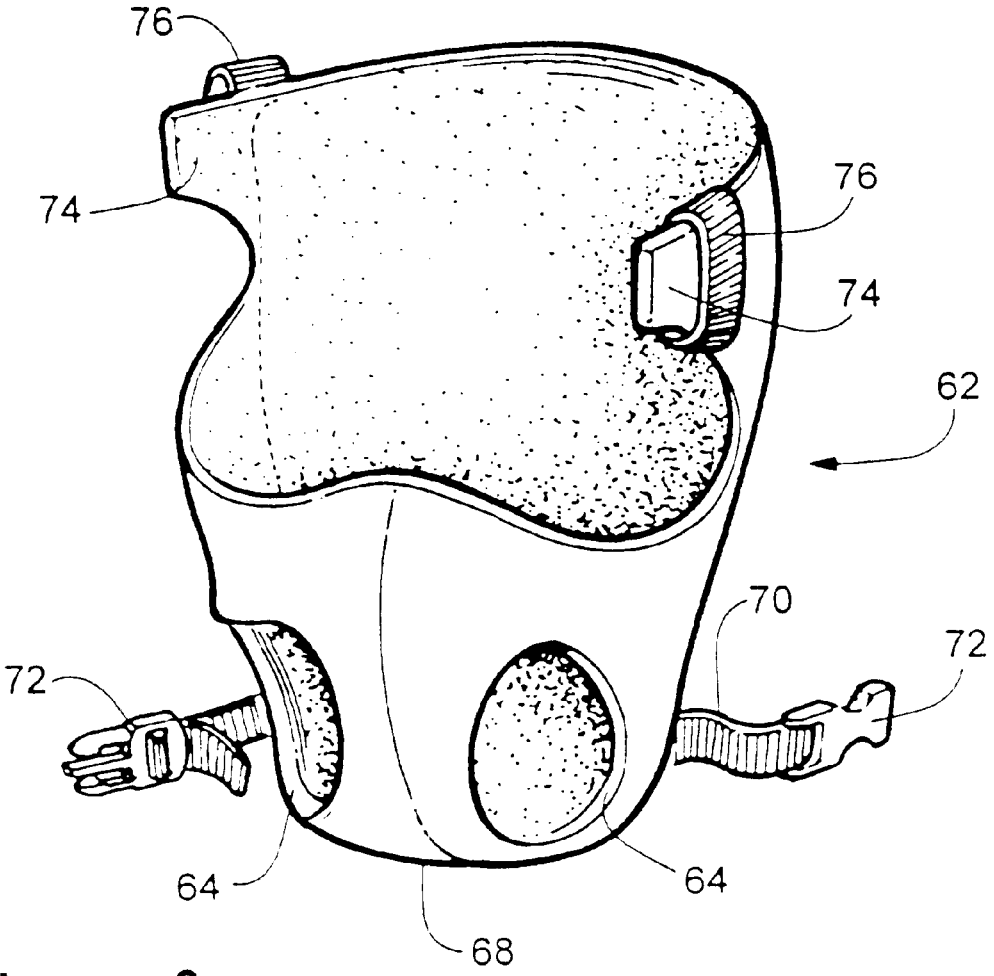
FIG. 3 depicts a frontal perspective view of a removable insert, used to accommodate small children, which is removably mountable into the infant support panel.

FIG. 3 depicts a frontal perspective view of one embodiment of a removable infant insert 62 removed from its removable attachment to body support panel 12. The infant insert 62 is made of multiple layers of preferably moisture repellent cushioned fabric, having two leg passages 64 at the lower end 68 whereby the legs of the infant are inserted through the infant insert 62 during use by a small child or infant. Means of attachment of the infant insert 62 to the body support panel 12 is provided as shown by retainer belt 70 on the back side which is equipped with a quick disconnect buckle 72 which also encompasses a conventional length adjustment mechanism. Using this means of attachment, the retainer belt 70 is wrapped around the body support panel 12. Also providing part of a means of attachment are sleeves 76 situated at the upper two corners 74 of the infant insert 62 through which the clasps 24 of the body support panel 12 may pass to their attachment to the rings 28 and thereby provide support to the upper portion when attached to the rings 28. Of course other means of attachment of the insert 62 to the support panel 12 might be used such as hook and loop fabric 102 or other conventional cooperating fasteners and such are anticipated.

Figure 4:
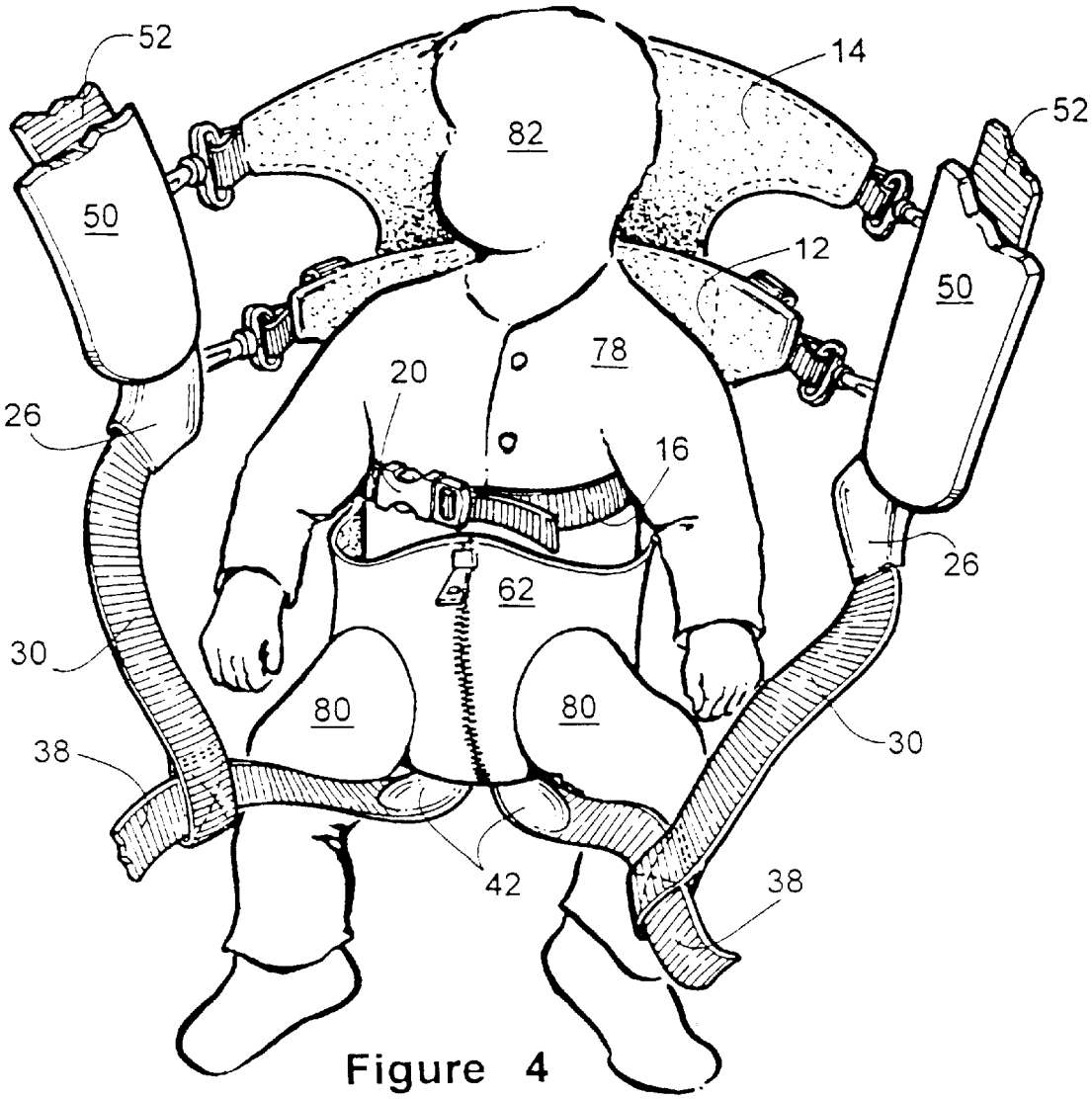
FIG. 4 depicts a perspective of the infant carrier with an infant sitting in the removable insert, looking from the care providers view, with the back support panel removed.

FIG. 4 depicts a perspective of a preferred embodiment of the infant carrier 10 with a small child 78 situated in the infant insert 62 with the insert removably mounted into the device 10. The insert 62 might also be provided in kit form wherein there are a plurality of different sized infant inserts 62 to accommodate infants and children of differing sizes and weights. The user could thus choose the correct sized insert 62 for the intended child occupant and then cooperatively engage that insert 62 with the device 10 using the aforementioned means of attachment. When the child is heavier or a new child of differing size is to be accommodated in the device 10, the user simply picks another of the inserts 62 from the various sized inserts in the collection and attaches it once the currently mounted insert 62 is removed. As seen in FIG. 4, the view is looking from the care providers view, with the back support panel 50 removed. This illustration shows clearly the location of the padded area 42 of the waist belt 38, and how they keep the child's legs 80 from chaffing, and the location of the upper head support 14 with respect to the child's head 82.

Figure 5:
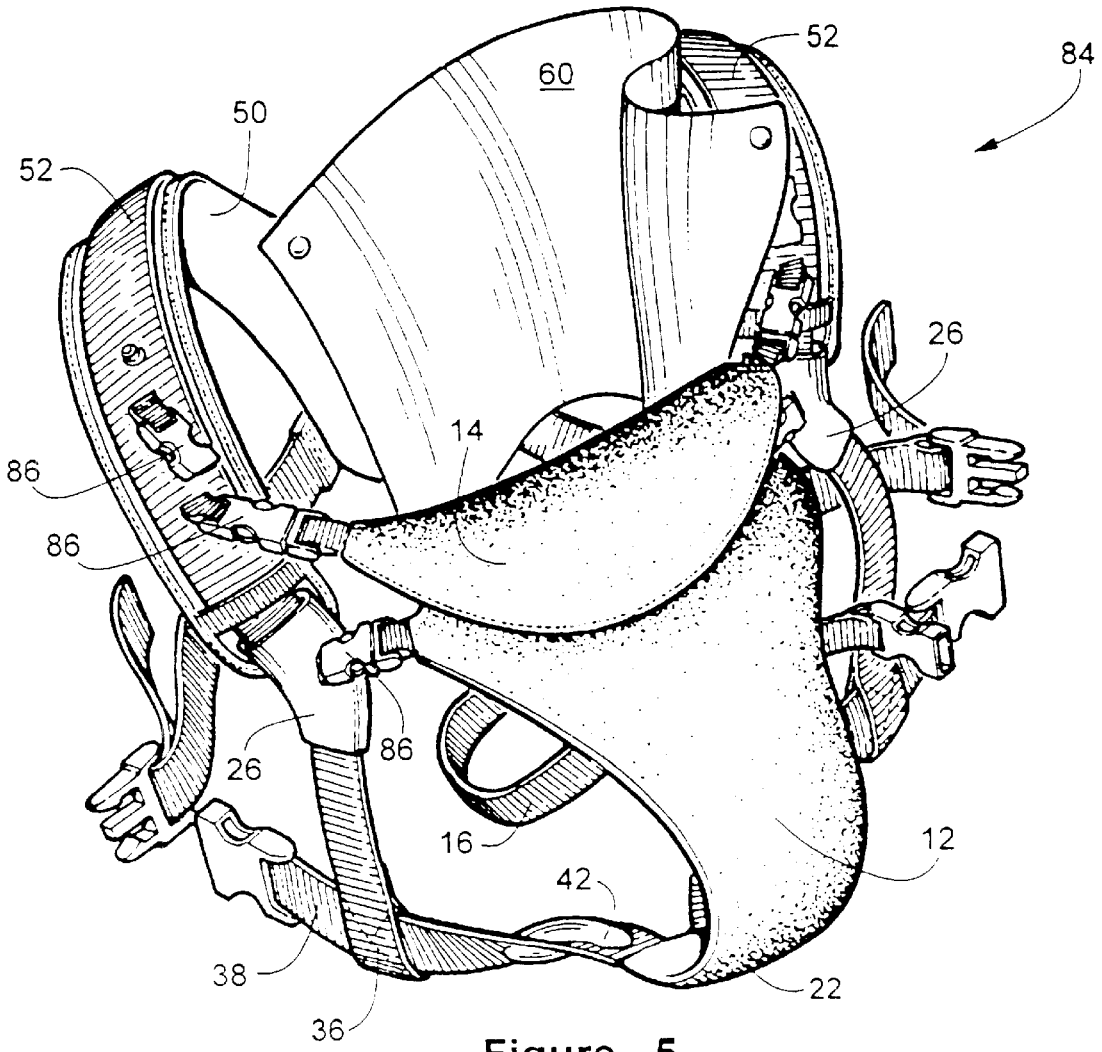
FIG. 5 depicts a perspective view of the alternate embodiment of the infant carrier assembly, displaying the quick disconnect buckles, and a removable bib attached to one of the snaps.

FIG. 5 depicts a perspective view of the alternate embodiment 84 of the infant carrier 10, displaying the quick disconnect cooperating buckles 86 as a means of attachment of the support panel 12 to the shoulder strap 52 and to the connecting belt 30. The buckles 86 would replace the clasp 24 and 56 along with the ring 28 attachments. Also noted in this illustration is the fact that the loop ends 36 of the shoulder strap 30 connecting belts 30 are sewn directly to the tubular waist belts 38.

Figure 6:
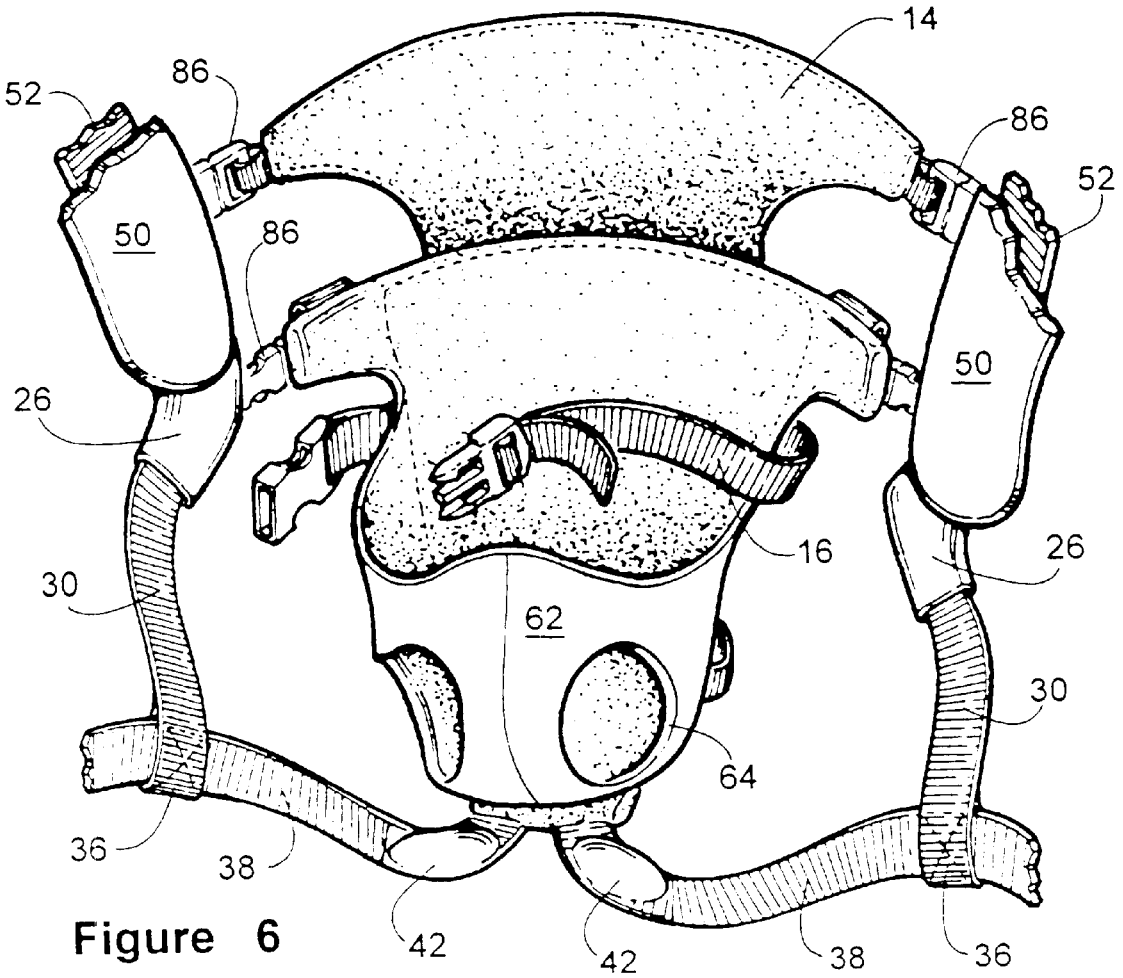
FIG. 6 depicts a perspective view of the device with the removably mountable infant seat insert in place.

FIG. 6 depicts a perspective of the embodiment of the infant carrier 10 and infant insert 62, from the other side from FIG. 1.

Figure 7:
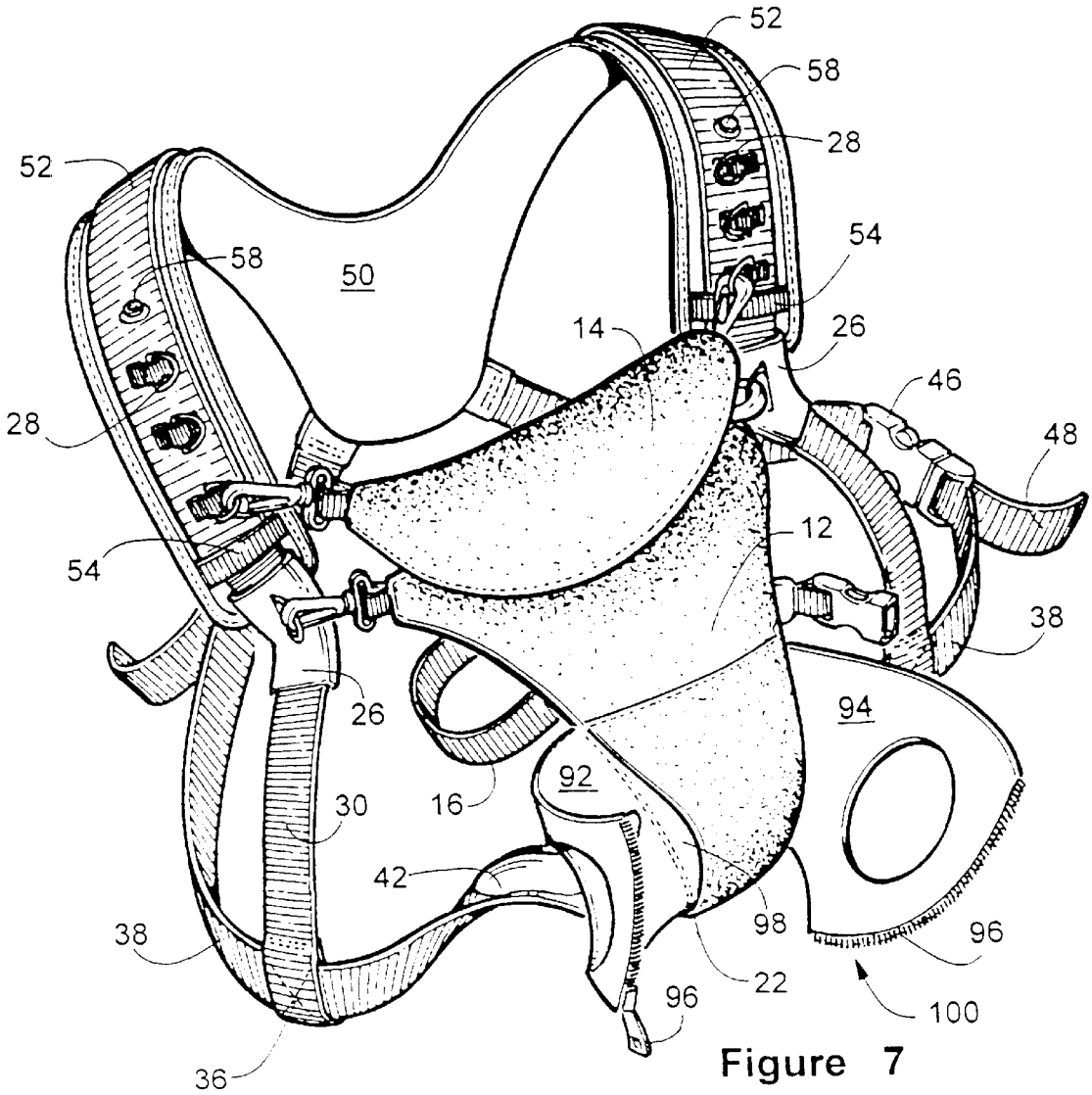
FIG. 7 depicts a retractable infant seat insert embodiment that folds into a pocket formed in the carrier assembly for easy storage when not in use.
Figure 8:
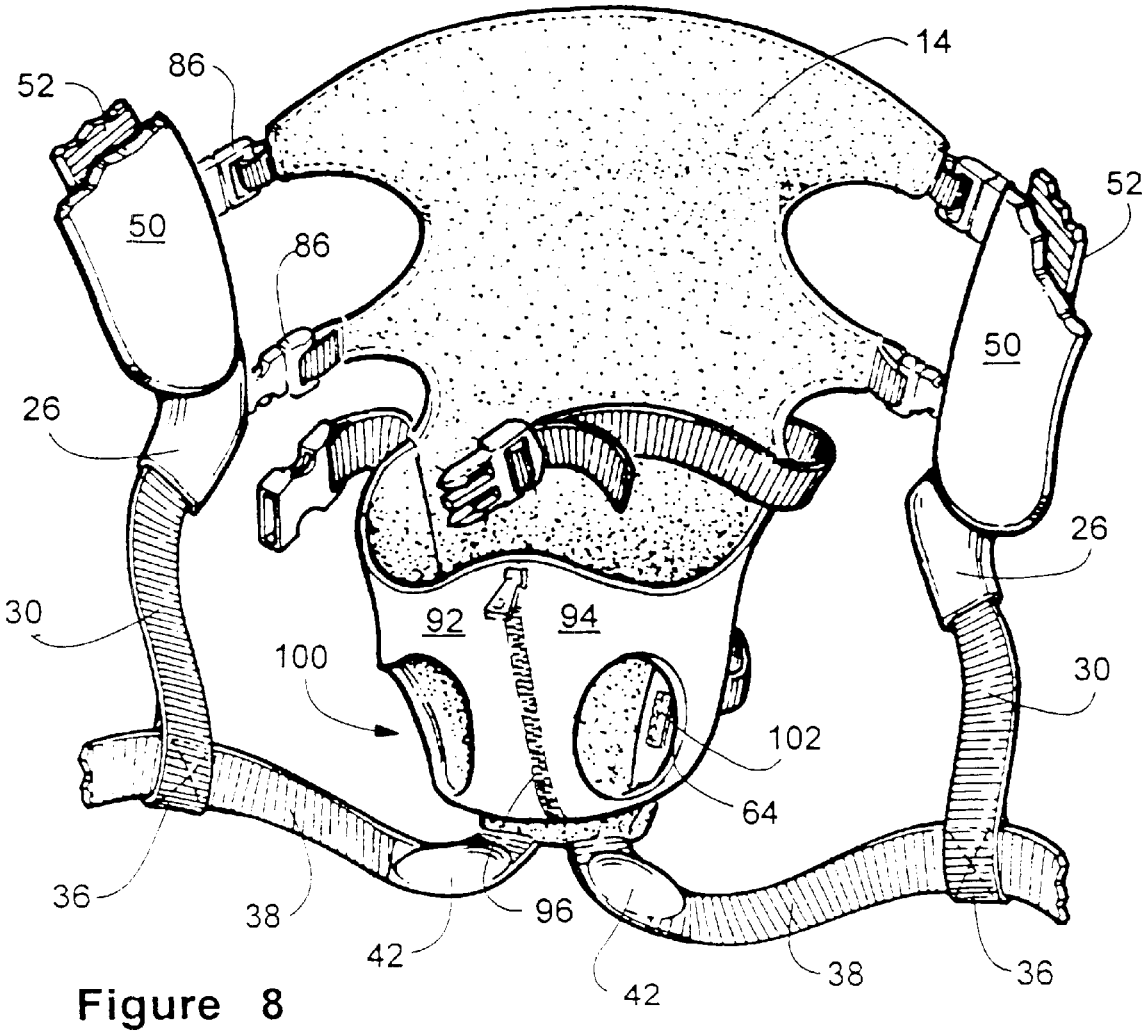
FIG. 8 depicts the retractable infant seat insert embodiment showing the device in operating position unfolded from the storage pocket and joined at the center.

FIG. 7 and FIG. 8 depict a retractable infant seat insert 62 embodiment that folds into a pocket or cavity 98 formed in the body support panel 12 for easy storage when not in use. This retractable seat insert 62 is easily stored in the cavity 98 formed in the body support panel 12 of the device 10. As shown from the opposite side of FIG. 7, the device as shown in FIG. 8, depicts the retractable infant seat insert 62 embodiment showing the device in operating position unfolded from the cavity 98 formed in the body support panel 12. This embodiment allows the seat insert 62 to be folded out for use when needed and then retracted back into the cavity 98 when not needed. Alternately, the insert 62 could be in two pieces each attached at the edge of the body support panel 12 adjacent to one side of the cavity 98. This version of the insert 62 could also be just retracted and folded away into the storage cavity 98 when not needed. When use of the insert 62 is required, the user simply pulls the two sides from their respective storage in the two openings in the cavity 98 on each side of the front wall of the body support panel 12 and zips them together using the zipper 96 having conventional joining sides 92 and 94, or other means of attachment of both sides of the insert 62. The device 10 is then ready for a small infant or baby to be safely inserted into the insert 62 of the device 10.

If a larger child is to use the device subsequently, the insert 62 is simply unzipped and tucked away into the cavity till needed again. A plurality of different sized inserts 62 as previously mentioned could be used to accommodate a plurality of different sized infants providing great utility to the user and all such inserts 62 can be stored in the on board cavity 98 till needed or elsewhere and inserted therein as needed.

Figure 9:
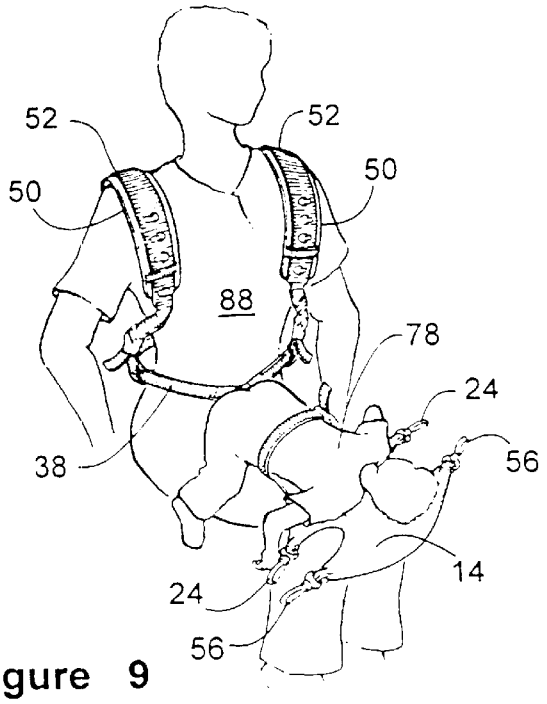
FIG. 9 depicts an embodiment of the device with the detachable from section allowing the care provider in a seated position to safely insert the child into the device.

FIG. 9 depicts a means for rotation of the body support panel 12 to a horizontal position with the child attached. This function, which would generally be used for insertion or removal of the child while on the sitting user's lap is provided by the detachment ability of the cooperating fasteners 56 and 28 at the top of the body support panel 12 while the user is sitting down. The bottom of the support panel 12 being attached to the waist belt 38 functions as a hinge for this rotation. A child 78 already in the device 10 can thus be easily lowered to a horizontal position resting on the user's lap while still secured by the belt 16 which keeps the child in place until released or re inverted by reattaching the fasteners 56 to the shoulder belt 52. The reverse of this function is especially valued for placing the child into the device 10 for those who are unable to lift the child into the device 10 while standing thus providing a means to insert the child into the device 10 without lifting the child over the top of the device. In such a case the user would sit down with legs extended to form a lap while wearing the device. The front flap or body support panel 12 would be detached from the shoulder belts 52 by detaching the aforementioned cooperative fasteners. The body support panel 12 would then be rotated to a flat position on the user's lap where the child 78 would be placed face down. Once the belt 16 is fastened around the child 78 the body support panel 12 would be raised up by raising the attached child to a vertical position and the fasteners reattached. It should be noted that the child 78 as shown, is positioned so that when raised it will be facing away from the user or care provider 88. The child could also be safely placed in the other position facing the care provider as shown in FIG. 4 and raised or lowered with equal ease and safety.

Figure 10:
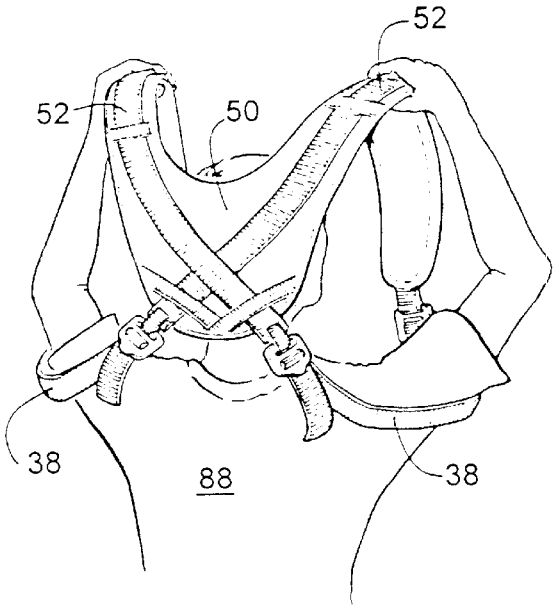
FIG. 10 depicts a care provider lowering the infant into the device with the support panel rotated to a horizontal position.

FIG. 10 depicts a care provider lowering the assembled device onto the care provider in a normal fashion.

FIG. 11 depicts a care provider adjusting the waist belt length using a means of adjustment in the form of adjustment mechanisms, by pulling the ends of the belts.

As noted above, the components of the disclosed device used in combination yield the best current embodiment of the disclosed device. However the components individually, or combined selectively, also yield a distinct improvement in current art either as a unit or when applied individually or together to existing child carriers. Consequently, use the components individually or in combination and used in combination with a baby carrier are anticipated. Still further, while all of the fundamental characteristics and features of the Child Carrier with Enhanced back and shoulder support and retractable infant seat have been shown and described herein, it should be understood that various substitutions, modifications and variations may be made by those skilled in the field, without departing from the spirit of scope of the invention. Consequently, all such modifications and variations are included within the scope of the invention as defined by the following claims.

What is claimed is:

1. A storage pocket and insert seat for use in combination with a child carrier having a body support panel supported by shoulder straps at a top portion and attached to the user at a bottom point on the body support panel comprising:

a storage pocket formed into said body support panel said storage pocket having at least one aperture providing access thereto;

said infant insert seat having a first half deployable from storage in said storage pocket and the second half deployable from storage in said storage pocket;

means of attachment of said first half of said infant insert seat to said second half of said infant insert seat to form said infant insert seat, whereby the user may store the infant insert seat in said storage cavity until needed and deploy it therefrom for use and later be able to return it thereto for storage when not needed.

2. An improved child carrier apparatus to be shoulder mounted on a user comprising:

a generally triangular shaped body support panel;

said support panel having a front surface, a back surface, an upper portion with two upper corners, and two diagonal side edges extending to a lower corner;

a back support panel, said back support panel having an interior surface and an exterior surface, a top right corner, a top left corner, a bottom right corner, and a bottom left corner;

a first shoulder strap diagonally affixed to said back support panel, said first shoulder strap having a top end and a bottom end, said first shoulder strap affixed to said back support panel in a manner to allow lateral translation of said first shoulder strap thereon;

a second shoulder strap diagonally affixed to said support panel, said second should strap crossing said first should strap, said second shoulder strap having a top end and a bottom end, said second shoulder strap affixed to said back support panel in a manner to allow lateral translation of said first shoulder strap thereon;

a first shoulder strap connecting belt connected at a top end to said top end of said first shoulder strap and at a bottom end to a first portion of said waist belt, said first portion of said waist belt extending from a first attachment at said bottom end of said support panel to a cooperative fastener communicating with said bottom end of said first shoulder strap;

a second shoulder strap connecting belt connected at a top end to said top end of said second shoulder strap and at a bottom end to a second portion of said waist belt, said second portion of said waist belt extending from an attachment at said bottom end of said support panel to a cooperative fastener communicating with said bottom end of said second shoulder strap;

means of adjustment of the length of said first portion of said waist belt;

means of adjustment of the length of said second portion of said waist belt;

means of removable attachment of said upper portion of said body support panel to attachment points supported by said first and second shoulder straps whereby said body support panel may be maintained in a substantially upright position when so attached;

said bottom portion of said support panel forming a seat when said support panel is removably attached to said attachment points;

a first leg opening defined by the area between said first shoulder strap connecting belt one of said diagonal side edges and said first portion of said waist belt; and a second leg opening defined by the area between said second shoulder strap connecting belt, the second of said diagonal edges and said second portion of said waist belt, whereby said child carrier supported by the shoulders of a user wearing the shoulder straps over the user's shoulders, will provide a body worn carrier for a child sitting in the formed seat in between the body of the wearer and the substantially upright support panel with the childs legs hanging through said first and second leg openings.

3. The improved child carrier apparatus as defined in claim 2 wherein said means of removable attachment of said upper portion of said body support panel to said attachment points supported by said first and second shoulder straps comprise:

fasteners attached to said body support panel adjacent to each of said two upper corners;

said cooperating fasteners removably attachable to cooperatively engageable fasteners located on said shoulder straps or said shoulder strap connecting belts.

4. The improved child carrier apparatus as defined in claim 2 wherein said means of removable attachment of said upper portion of said body support panel to said attachment points supported by said first and second shoulder straps comprise:

fasteners attached to said body support panel adjacent to each of said two upper corners;

a plurality of spaced cooperative fasteners extending down said shoulder straps to said shoulder strap connecting belts;

said fasteners on said body support panel cooperatively engageable with any of said cooperative fasteners; and engagement with cooperative fasteners higher or lower on said shoulder straps thereby providing a means of adjustment of the height of the top of said body support panel.

5. The improved child carrier apparatus as defined in claim 2 further comprising:

a head support panel having a top side and a bottom side attached to said top of said upper portion;

support fasteners attached to said top side of said head support; and said support fasteners engageable with cooperating support fasteners located on said shoulder straps.

6. The improved child carrier apparatus as defined in claim 2 further comprising:

a first diagonal pathway extending across said back support panel, said first diagonal pathway extending under a diagonally affixed first cross belt at said top left corner, across said exterior surface, and under a second diagonally affixed cross belt placed at a bottom right corner, said second diagonally affixed cross belt parallel to the first diagonally affixed cross belt;

a second diagonal pathway extending across said back support panel cutting across said first diagonal pathway, said second diagonal pathway extending under a diagonally affixed third cross belt at said top right corner, across said exterior surface, and under a second diagonally forth cross belt placed parallel at bottom right corner, said forth diagonally affixed cross belt parallel to the third diagonally affixed cross belt; and said first shoulder strap being laterally translatable in said first diagonal pathway and said second shoulder strap being laterally translatable in said second diagonal pathway.

7. The improved child carrier apparatus as defined in claim 2 further comprising:

a retainer belt attached to said body support panel, said retainer belt having two halves, one end of each half attached to said body support panel, the second end of each half being attachable to each other using a cooperative fastener attached thereto, whereby said retainer belt may be encircled around the body of a child sitting in said seat portion when said upper portion of said body support panel is removably attached to said support points and also when removed from attachment to said support points.

8. The improved child carrier apparatus as defined in claim 7 further comprising:

means for rotation of the body support panel to a generally horizontal position with the child attached comprising:

said retainer belt being affixed around the body of the child occupant of said child carrier apparatus;

detachment of said means of removable attachment of said upper portion of said body support panel from said attachment points supported by said first and second shoulder straps while concurrently holding said two upper corners of said body support panel; and rotating said body support panel on its attachment to said waist band by gripping said two upper corners of said body support panel and keeping said body support panel taught while moving said upper corners toward the knees of the sitting wearer until the child is supported by the legs of the wearer.

9. The improved child carrier apparatus as defined in claim 2 further comprising means to means to keep the body support panel and child therein disposed in a generally upright position when worn by a user bending forward.

10. The improved child carrier apparatus as defined in claim 9 wherein said means to keep the body support panel and child therein disposed in a generally upright position when worn by a user bending forward comprises:

a stiffener affixed to said waist belt between the connection point of said waist belt to said should shoulder strap connecting belt and said lower corner of said body support panel; and, the length of the portions of the waist belt situated between the connection point of said waist belts to said should shoulder strap connecting belts and said lower corner of said body support panel being of a length calculated to remain slack in slack portions of said waist belt, whereby when said waist belt is cinched upon the user, and said user bends forward, said slack portion allows the lower corner of said body support panel to swing away from the wearer aided by the action of said stiffener, for the distance provided by said slack, thereby allowing the body support panel to remain generally upright.

11. The improved child carrier apparatus as defined in claim 2 further comprising:

a removable infant insert seat removably attachable to the body support panel, said removable infant insert sized to accommodate a infant too small to be safely held by said seat formed in said body support panel; and means of removable attachment of said infant insert seat to said body support panel.

12. The improved child carrier apparatus as defined in claim 11 in a kit, said kit comprising a plurality of different sized removable infant insert seats each of a different size whereby one of said plurality may be chosen to accommodate the size of the infant intended to occupy said child carrier and therein removably attached to said body support panel.

13. The improved child carrier apparatus as defined in claim 11 further comprising:

a storage cavity formed into said body support panel said storage cavity having at least one aperture providing access thereto; and said storage cavity sized to accommodate storage of said removable infant insert seat therein.

14. The improved child carrier apparatus as defined in claim 11 further comprising:

a storage pocket formed into said body support panel said storage pocket having at least one aperture providing access thereto;

said infant insert seat having a first half deployable from storage in a first of said two apertures and the second half deployable from a second of said two apertures;

means of attachment of said first half of said infant insert seat to said second half of said infant insert seat to form said infant insert seat, whereby the user may store the infant insert seat in said storage cavity until needed and deploy it therefrom for use and later detach the two halves from attachment to return them to storage when not needed.

15. The improved child carrier apparatus as defined in claim 11 further comprising:

a storage pocket formed into said body support panel said storage pocket having a pair of apertures providing access thereto, said apertures adjacent to said two diagonal side edges of said body support panel;

said infant insert seat having a first half deployable from storage in a first of said two apertures and the second half deployable from a second of said two apertures;

means of attachment of said first half of said infant insert seat to said second half of said infant insert seat to form said infant insert seat, whereby the user may store the infant insert seat in said storage cavity until needed and deploy it therefrom for use and later be able to return it thereto for storage when not needed.

16. The improved child carrier apparatus as defined in claim 15 wherein said first half of said infant insert seat is permanently attached to said body support panel adjacent to said first of said apertures and said second half of said infant insert seat is permanently attached to said body support panel adjacent to said second of said apertures.

* * * * *